US005361675A

United States Patent [19]

Spektor et al.

[11] Patent Number: 5,361,675

[45] Date of Patent: Nov. 8, 1994

[54] MAGNETIC MINE DETONATION APPARATUS

[75] Inventors: Moshe Spektor; Gil Shalev, both of Beersheva; Yair Sagie, Rehovot, all of Israel

[73] Assignee: Israel Aircraft Industries Ltd, Lod, Israel

[21] Appl. No.: 6,294

[22] Filed: Jan. 19, 1993

[30] Foreign Application Priority Data

Jun. 18, 1992 [IL] Israel ..... 102256

[51] Int. Cl.[5] ..... F41H 11/12

[52] U.S. Cl. ..... 89/1.13; 324/345

[58] Field of Search ..... 89/1.13, 36.01, 36.08; 102/402, 403; 324/345

[56] References Cited

U.S. PATENT DOCUMENTS

| | | | |
|---|---|---|---|
| 2,397,209 | 3/1946 | Schaelchlin | 102/403 |
| 3,826,215 | 7/1974 | Dyjak | 114/221 R |
| 3,939,753 | 2/1976 | Rosborough et al. | 89/1.13 |
| 4,021,725 | 5/1977 | Kirkland | 324/326 |
| 4,417,518 | 11/1983 | Siebert et al. | 102/212 |
| 4,467,694 | 8/1984 | Azulai et al. | 89/1.13 |
| 4,491,053 | 1/1985 | Bar-Nefy et al. | 89/1.13 |
| 4,552,053 | 11/1985 | Bar-Nefy et al. | 89/1.13 |
| 4,580,497 | 4/1986 | Erdmann et al. | 102/212 |
| 4,590,844 | 5/1986 | Bar-Nefy et al. | 89/1.13 |
| 4,593,766 | 6/1986 | Gossard | 171/63 |
| 4,727,940 | 3/1988 | Bar-Nefy et al. | 171/84 |
| 4,811,665 | 3/1989 | Clutterbuck | 102/427 |
| 4,840,105 | 6/1989 | Ladan et al. | 89/1.13 |
| 4,938,136 | 7/1990 | Gould | 102/406 |
| 4,951,571 | 8/1990 | Bane | 102/402 |
| 4,993,325 | 2/1991 | Slone et al. | 324/345 |
| 5,027,709 | 7/1991 | Slagle | 102/427 |
| 5,125,317 | 6/1992 | Spektor et al. | 89/1.13 |

FOREIGN PATENT DOCUMENTS

| | | | |
|---|---|---|---|
| 289692 | 11/1988 | European Pat. Off. | 89/1.13 |
| 338901 | 10/1989 | European Pat. Off. | 89/1.13 |
| 3424231 | 1/1986 | Germany . | |
| 3444037 | 6/1986 | Germany . | |
| 1050490 | 12/1962 | United Kingdom . | |
| 2034011 | 5/1980 | United Kingdom . | |

*Primary Examiner*—Stephen C. Bentley

*Attorney, Agent, or Firm*—Jacobson, Price, Holman & Stern

[57] ABSTRACT

Apparatus for activating different types of magnetic trigger mechanism employed by different types of magnetic mine. The magnetic trigger activating apparatus includes apparatus for modifying the magnetic field sensed by each different type of magnetic trigger mechanism in a predetermined varying manner, thereby causing activation of each different type of magnetic trigger mechanism and thus detonation of each different type of magnetic mine when the apparatus for modifying is at least a predetermined minimum distance therefrom.

6 Claims, 9 Drawing Sheets

MAGNETIC MINE DETONATION APPARATUS

FIELD OF THE INVENTION

The present invention relates to vehicle mountable mine clearing apparatus in general and, more particularly, to vehicle mountable magnetic mine clearing apparatus.

BACKGROUND OF THE INVENTION

It is known in tank warfare to employ mine clearing apparatus mounted on a vehicle for clearing a path through a mine field.

There is described in U.S. Pat. Nos. 4,491,053, 4,467,694, 4,552,053, 4,590,844 and 4,727,940 mine clearing apparatus mountable on a tracked vehicle and which includes a pair of plow members mounted in front of the vehicle tracks.

U.S. Pat. No. 4,840,105 describes an element for exploding magnetic mines comprising a permanent magnet arranged for driven engagement with a ground surface, so as to provide rotation of the permanent magnet. The permanent magnet is disposed at a distance in front of a vehicle to be protected from mines, rotation of the permanent magnet providing premature detonation of mines in the vicinity thereof at a safe distance in front of the vehicle.

Magnetic mines include trigger mechanisms which are operative to detect changes in a range of predetermined intensities and in a range of predetermined frequencies in the surrounding magnetic field. The predetermined intensities and frequencies are selected to be similar to those that would be produced by travel of a heavy vehicle, such as a main battle tank. For any specific vehicle, the local changes to the surrounding magnetic field constitute the 'magnetic signature' of that vehicle.

Different types of magnetic mine trigger mechanism are operative to respond to different types of magnetic signature. While the element described in U.S. Pat. No. 4,840,105 is effective in causing detonation of magnetic mines, a given element such as described cannot be used for simultaneous detonation of several types of magnetic mine of different manufacture, when the trigger mechanism of each different type of mine is responsive to a magnetic signature outside of that provided by the described element.

U.S. Pat. No. 4,951,571 entitled "Drum Minesweeper" describes a floating minesweeper for neutralizing marine mines. The minesweeper employs, inter alia, a plurality of permanent magnets for neutralizing magnetic marine mines, and is thus subject to a limitation similar to that of the element described in the above-summarized U.S. Pat. No. 4,840,105.

U.S. Pat. No. 4,938,136, entitled "Resonant Acoustic-magnetic Minesweeper", is a towed minesweeper which is adapted to be towed in a suitable marine or land environment. The minesweeper employs an acoustic-magnetic generator for producing acoustic energy and magnetic energy which, when directed at an appropriate type of mine, causes self-destruction thereof. Magnetized pipes are employed for production of magnetic energy. The magnetized pipes are also effected by the acoustic energy produced by the generator so as to vibrate and thus cause varying or alternating magnetic fields. Varying or alternating magnetic fields are also stated as being given to being produced by means of solenoid coils powered by an ac current source.

The use of a simple ac current source for directly powering solenoid coils provides a magnetic field which varies through a fixed cycle. While such a system may, therefore, be effective in causing detonation of magnetic mines, per se, it cannot provide simultaneous detonation of several types of magnetic mine of different manufacture, when the trigger mechanism of each different type of mine is responsive to a magnetic signature outside of that provided by the described system.

SUMMARY OF THE INVENTION

It is an aim of the present invention to provide improved magnetic mine detonation apparatus capable of causing premature detonation of different types of magnetic mine at a minimum predetermined distance from the detonation apparatus.

It is also an aim of the invention to provide a mobile system for causing detonation of different types of magnetic mine at a minimum safe distance from the system, thereby clearing a safely traversable path through a mine field.

Yet a further aim of the present invention is to provide a mobile system for clearing a safely traversable path through a mine field in which are present various types of magnetic mine and nonmagnetic mines.

There is provided, therefore, in accordance with a preferred embodiment of the invention, apparatus for activating different types of magnetic trigger mechanism employed by different types of magnetic mine. The magnetic trigger activating apparatus includes apparatus for modifying the magnetic field sensed by each different type of magnetic trigger mechanism in a predetermined varying manner, thereby causing activation of each different type of magnetic trigger mechanism and thus detonation of each different type of magnetic mine when the apparatus for modifying is at least a predetermined minimum distance therefrom.

Additionally in accordance with an embodiment of the invention, the apparatus for modifying includes an electromagnet arranged to provide an electromagnetic field which varies through a cycle selected to be sensible by each different type of magnetic trigger mechanism, and thereby causes activation of each type of magnetic trigger mechanism when the electromagnet is at at least a predetermined distance therefrom.

Further in accordance with an embodiment of the invention, there is also provided apparatus for applying a voltage across the electromagnet in a waveform configuration which varies between maximum and minimum voltages and at a plurality of different frequencies, thereby providing an electromagnetic field varying, at the plurality of different frequencies, between maximum and minimum intensities which correspond respectively to the maximum and minimum voltages, wherein the variations in the electromagnetic field cause activation of each of the different magnetic trigger mechanisms employed by the plurality of different mines.

Additionally in accordance with an embodiment of the invention, there is also provided, in operative association with the electromagnet, switching apparatus for providing a voltage having a generally square waveform approximating to a sinusoidal waveform.

In accordance with an additional embodiment of the invention, there is provided a mobile system for activating different types of magnetic trigger mechanism employed by different types of magnetic mine, the system including a vehicle; and apparatus, configured for mounting on the vehicle, for modifying the magnetic field sensed by each different type of magnetic trigger mechanism in a predetermined varying manner, thereby causing activation of each different type of magnetic trigger mechanism and thus detonation of each different type of magnetic mine when the system is at at least a predetermined distance therefrom.

In accordance with yet a further embodiment of the invention, there is provided a mobile system for clearing a safely traversable path through a mine field in which are located nonmagnetic mines and different types of magnetic mine employing different types of magnetic trigger mechanism. The system includes a vehicle, apparatus mounted onto the vehicle for clearing a safely traversable path through a field of nonmagnetic mines, and apparatus mounted onto the vehicle for modifying the magnetic field sensed by each different type of magnetic trigger mechanism in a predetermined varying manner, thereby to cause activation of each different type of magnetic trigger mechanism and thereby also to cause detonation thereof when the apparatus for modifying the magnetic field is at at least a predetermined minimum distance therefrom.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
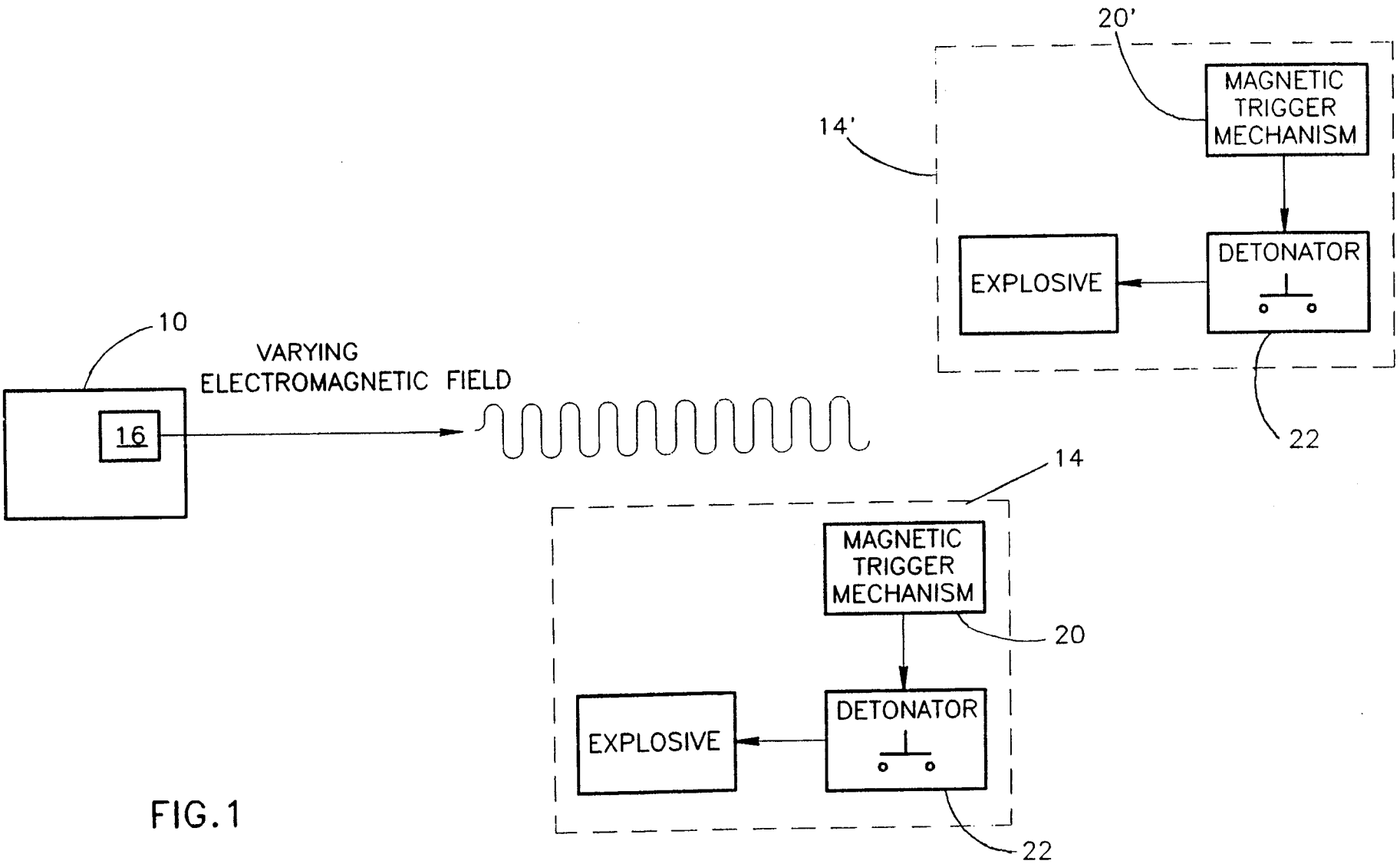
FIG. 1 is a block diagram illustration of a magnetic mine detonation system, constructed and operative in accordance with an embodiment of the present invention.

Reference is made to FIG. 1, in which is illustrated a mounting platform 10 for apparatus for detonating magnetic mines constructed and operative in accordance with an embodiment of the present invention. Mounting platform 10 is typically, but not necessarily, a vehicle.

Detonation of a magnetic mine used in modern warfare is provided by a magnetic trigger mechanism 20 in response to predetermined changes in the magnetic field sensed thereby. The predetermined changes to the magnetic field and to which magnetic trigger mechanism 20 responds correspond to portions of the magnetic signatures of heavy vehicles, such as main battle tanks.

There are a number of different types of trigger mechanism employed by magnetic mines. Activation of any given trigger mechanism depends, in general terms, on a change in the intensity of the sensed magnetic field and on the rate of change of the magnetic field.

Among the various types of magnetic trigger mechanism employed are the 'integrator and threshold' and the 'pulse counter' types.

The integrator and threshold type is operative to integrate with respect to time the value of the intensity of a magnetic field which, over a minimum time period, has an intensity of at least a minimum value, and which subsequently drops below the minimum value. With this type of trigger mechanism, therefore, detonation of the mine occurs after a predetermined time period has elapsed after the intensity of the magnetic field has dropped below the minimum value. Activation of this type of trigger mechanism thus requires a magnetic field which is sustained at at least a predetermined minimum intensity prior to dropping to below the minimum intensity, and which changes at a relatively low frequency.

The pulse counter type of trigger mechanism is sensitive to the presence of a rapidly varying magnetic field, and produces a 'pulse' each time the derivative with respect to time of the change in the value of the intensity of the magnetic field exceeds a predetermined value, such as might occur in a relatively high frequency sinusoidal waveform. Detonation of the mine occurs after a predetermined number of such pulses have been counted.

As described below, particularly in conjunction with FIGS. 2 and 3, the present invention includes an electromagnetic field generator 16, that is typically, but is not necessarily, vehicle-mounted. Electromagnetic field generator 16 is capable of providing the different magnetic field changes required so as to ensure premature detonation of different types of magnetic mine in a mine field at a distance from the vehicle that is sufficient so as not to cause damage to the vehicle or to its occupants.

In order to detonate magnetic mines employing either of the 'integrator and threshold' or the 'pulse counter' type of magnetic trigger mechanism, the electromagnetic field generator 16 is operated, by an electronic switching system 51 (FIG. 2), so as to produce an electromagnetic field whose intensity changes in a manner and at frequencies that will activate both types of trigger mechanism.

Figure 2:
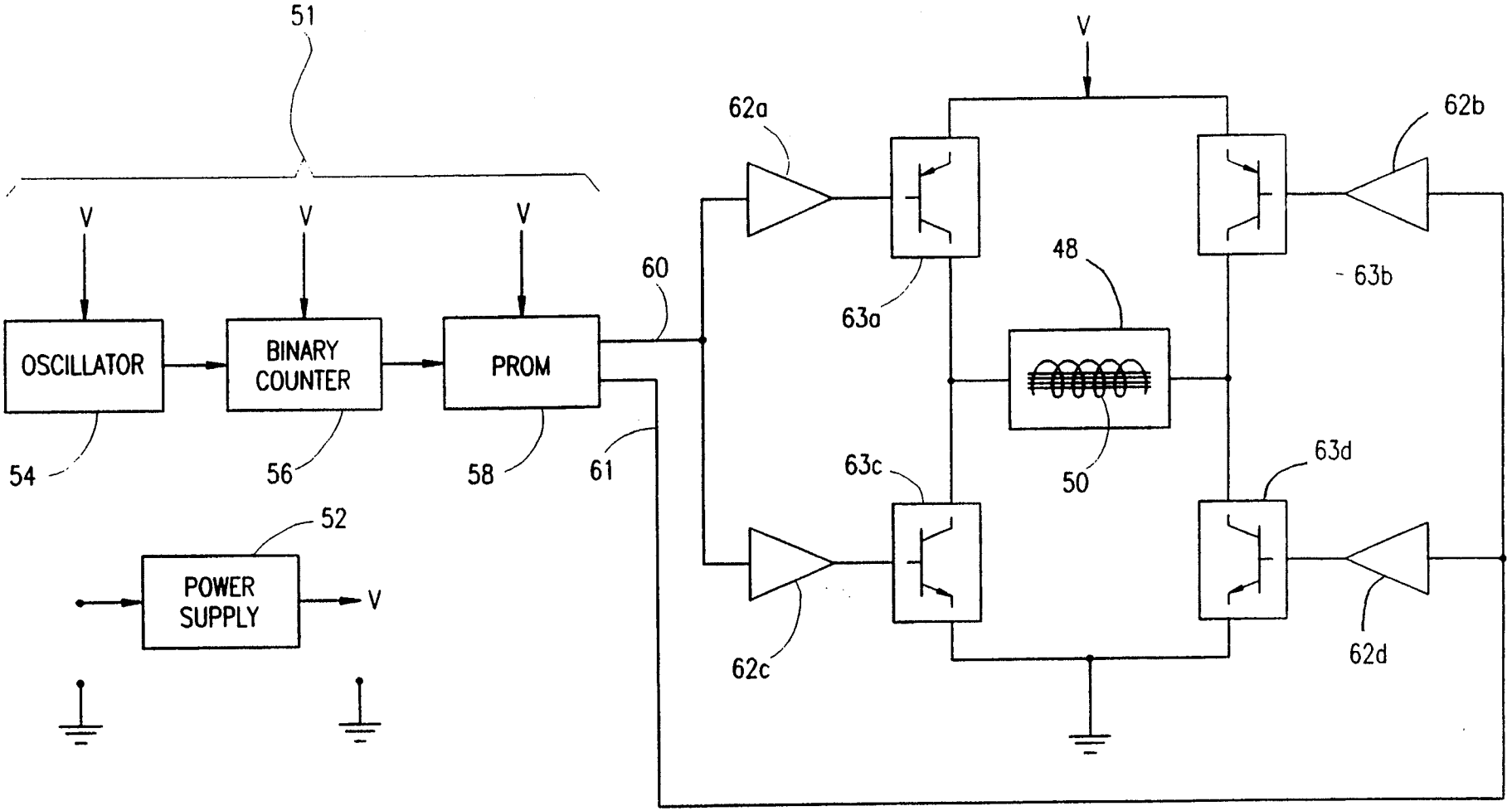
FIG. 2 is a block diagram illustration of the electromagnetic field generator of FIG. 1.
Figure 3:
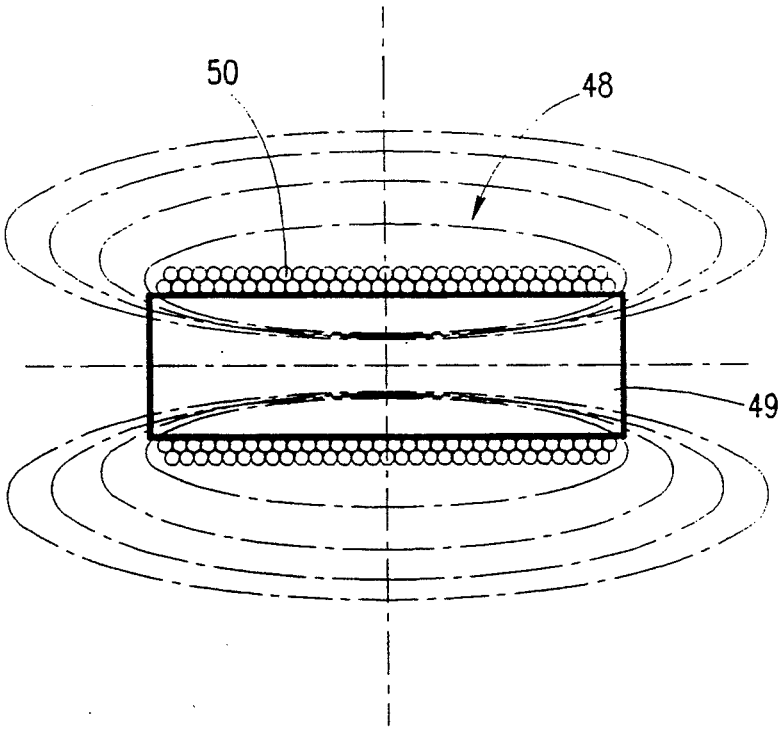
FIG. 3 is a schematic illustration of an electromagnet employed in the electromagnetic field generator depicted in FIG. 2.

Referring now to FIG. 2, electromagnetic field generator 16 includes preferably an open-ended electromagnet 48, illustrated also in FIG. 3. Electromagnet 48 has a core 49 (FIG. 3) and a coil 50 to which power is supplied via switching system 51 from a power supply 52, which supplies a stabilized voltage V to all components of the switching system.

The switching system 51 includes an oscillator 54, a cyclic binary counter 56, and a PROM (programmable read only memory) 58. Oscillator 54, binary counter 56, and PROM 58 are connected in series. Oscillator 54 is operative to provide a square signal to binary counter 56 at a frequency that determines the time periods of voltage cycles across coil 50.

Binary counter 56 is operative, in response to the square signal provided from oscillator 54, to count from 0 to 255 milliseconds. The exits from binary counter 56 scan the addresses of PROM 58. PROM 58 contains pre-programmed information that determines the shape of the signals at its two data exits, referenced 60 and 61. It will be appreciated that the memory capacity of the PROM determines the resolution of the data signals. Typically, PROM 56 has a 256×2 bits capacity.

The signal outputs provided via data exits 60 and 61 switch low power drivers 62*a*, 62*b*, 62*c* and 62*d* which, in turn, switch switches 63*a*, 63*b*, 63*c* and 63*d*, respectively, to high supply. Switches 63*a*, 63*b*, 63*c* and 63*d* are connected in an H bridge arrangement to coil 50. Switches 63*a* and 63*b* are of the current source variety and switch to coil 50 the positive terminal of voltage V, while switches 63*c* and 63*d*, are of the current sink variety and switch coil 50 to ground.

Figure 4:
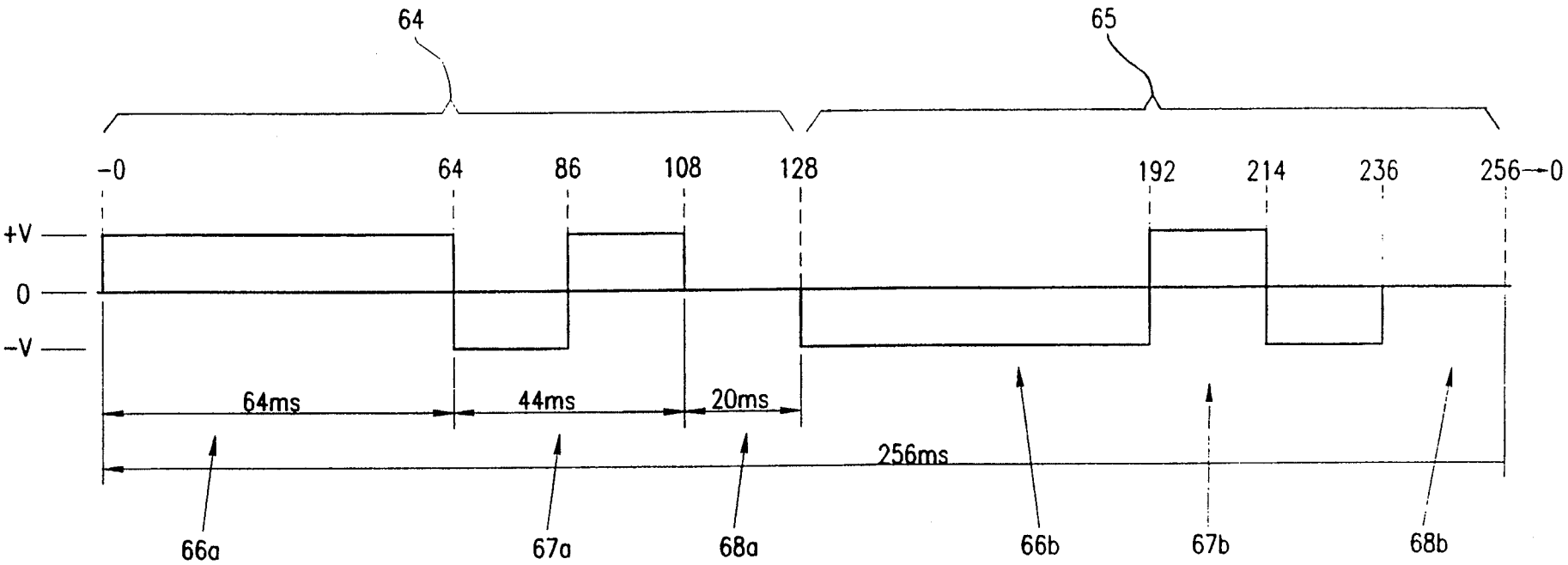
FIG. 4 illustrates a waveform representation of a typical voltage cycle across an electromagnet employed in an the electromagnetic field generator of FIG. 2.

A cyclic variable voltage, having a waveform such as depicted in FIG. 4, is applied across coil 50. The precise configuration and frequency of the waveform are determined by the switching of switches 63*a*, 63*b*, 63*c*, and 63*d* in accordance with the data programmed into PROM 58. The precise programming of PROM 58 so as to cause operation of switches 63*a*, 63*b*, 63*c* and 63*d* in a manner that will achieve a given waveform is according to techniques well known in the art, and the details thereof are thus not described herein.

The varying voltage across coil 50 causes a change in the current flowing therethrough, so as to result in a corresponding varying electromagnetic field about the coil, whose shape and frequency are determined, as discussed above, by the data programmed into PROM 58.

Reference is now made to FIG. 4, in which is illustrated the waveform of a typical voltage cycle that, when applied across coil 50 of electromagnetic field generator 16 (FIGS. 1 and 2) will give rise to an electromagnetic field in the vicinity thereof, so as to activate the magnetic trigger mechanisms of both the 'integrator and threshold' and 'pulse counter' types.

The voltage range may be selected, as appropriate, to give rise to an electromagnetic field that is sensible at a selected distance from the electromagnetic field generator 16.

In order to provide a varying electromagnetic field to activate both the 'integrator and threshold' and the 'pulse counter' types of magnetic trigger mechanism, the voltage cycle, in the present example, is characterized by the following:

1. variation between predetermined voltages giving rise to an electromagnetic field varying between extreme values sensible by both types of magnetic trigger mechanism;
2. low frequency changes, so as to activate the integrator and threshold type of mechanism; and
3. high frequency changes and the provision of a 'zero period' so as to activate the pulse counter type of mechanism.

The cycle configuration and, in particular, the cycle intensity, is further governed by the requirement that activation of the trigger mechanism and consequent detonation of the mine must occur at at at least a predetermined minimum safe distance from the vehicle on which the apparatus of the invention is mounted. According to the example of FIGS. 6A and 6B, wherein the vehicle is a main battle tank, a safe detonation distance is no less than 0.5 m.

It will be appreciated that the cycle has to be configured so as to cause detonation of the mine at a safe distance from the tank regardless of the portion of the cycle first sensed by the magnetic trigger mechanism. Accordingly, the cycle is configured to have two similar sub-cycles, indicated generally by referenced numerals 64 and 65. In the present example, the absolute values of time corresponding portions of the sub-cycles are similar, although of opposite polarity.

Sub-cycle 64 includes portions referenced 66*a*, 67*a* and 68*a*, lasting, in the present example, for approximately 64 ms, 44 ms and 20 ms. The portions of sub-cycle 65 corresponding to portions 66*a*, 67*a* and 68*a* are referenced 66*b*, 67*b* and 68*b*, respectively.

Portion 66*a* represents the time period over which a magnetic field of at least a minimum strength is required to be sensed by the trigger mechanism of the integrator and threshold type. Operation of the electromagnet at a maximum intensity for approximately 64 ms is equivalent to a relatively low frequency of 4 Hz.

Portion 67*a* represents a cycle required for detonation of the trigger mechanism of the pulse counter type. As described hereinabove, the pulse counter type of mechanism is sensitive to high frequency changes in the magnetic field. Three such changes occur in a time period of approximately 44 ms, at the 64, 86 and 108 ms stages, whereat the voltage applied across the electromagnetic coil is changed from one extreme value to the other extreme value, or is changed from an extreme value to zero.

Portion 68*a* represents a "zero" period, which corresponds to the portion of a sinusoidal waveform, (such as would be produced by a tank in motion), wherein the change in the sensed magnetic field is below a minimum value.

Table 1, below, is a summary of the switching operations controlled by PROM 58 (FIG. 2), in response to a series of predetermined output signals from cyclic binary counter 56 (FIG. 2), so as to achieve the exemplary waveform shown and described above in conjunction with FIG. 4.

TABLE 1

Pre-programmed Control Signals For A Typical Voltage Waveform Across Electromagnet 48

| Binary Counter FROM Output TO | 0 | 64 | 86 | 108 | 128 | 192 | 214 | 236 |
|---|---|---|---|---|---|---|---|---|
| | 63 ms | 85 ms | 107 ms | 127 ms | 191 ms | 213 ms | 235 ms | 255 ms |
| PROM Output | | | | | | | | |
| Exit 60 | 1 | 0 | 1 | 1 | 0 | 1 | 0 | 0 |
| Exit 61 | 0 | 1 | 0 | 1 | 1 | 0 | 1 | 0 |

Figure 5:
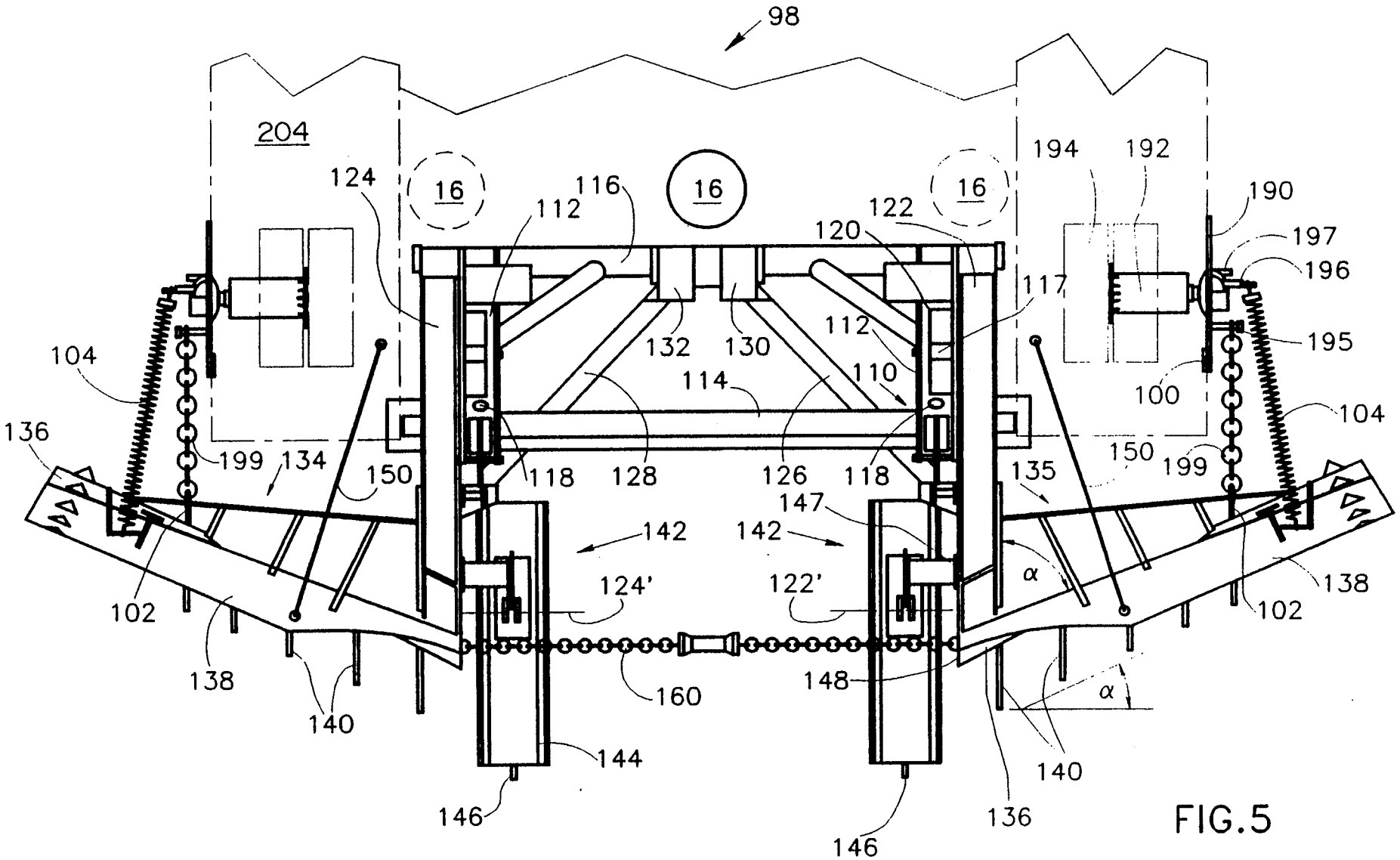
FIG. 5 is a schematic plan view of a front portion of a tracked vehicle having mounted thereon a combination mine clearing system employing both the magnetic mine detonation system of the invention and apparatus for clearing nonmagnetic mines.

Reference is now made to FIG. 5, which is a schematic plan view of a front portion of a tracked vehicle 98, e.g. an M-1 tank, having mounted thereon a combination mine clearing system which incorporates the magnetic mine detonation apparatus of the invention and nonmagnetic mine detonation apparatus. The nonmagnetic mine detonation apparatus may be any apparatus suitable for clearing at least one of pressure-activated mines and antenna operated mines, for example.

The illustrated nonmagnetic mine clearing apparatus, in the present example, is mine field plowing apparatus. The plowing apparatus includes a frame 110 having a pair of identical side portions 112, which are joined at their front end by a cross bar 114 and at their rear end support by an axle 116. Frame 110 is rigidly mounted onto vehicle 98 by engagement of pins 117 located at side portions 112 with towline lugs fixed onto the vehicle. Rigidity of mounting is provided by bolts 118 which engage the underside of the tank and force mounting plates 120, fixedly mounted onto side portions 112 on the opposite side of pins 117, into tight engagement with the underside hull of the vehicle.

First and second arms 122 and 124 are independently rotatably mounted onto axle 116 and extend forwardly thereof in generally parallel planes. Arms 122 and 124 are strengthened by reinforcing elements 126 and 128 respectively which are fixed at one end thereof to the respective arms and are rotatably mounted by means of clamps 130 and 132 onto axle 116.

Rigidly mounted onto each of arms 122 and 124 is a mine plowing assembly 134 and 135. Each mine plowing assembly 134 and 135 has a main plow portion 136 of generally elongate configuration and concave cross section.

The general configuration of main plow portion 136 may be similar to that of an ordinary vehicle-powered snow plow. Disposed above main plow portion 136 and hinged thereonto is an auxiliary plow portion 138. Auxiliary plow portion 138 has two positions, a lowered position in which it extends forwardly of the surface of the main plow portion 136 and a raised position in which it defines an upper continuation of the surface of the main plow portion 136. This hinged construction is to obviate the problem of interference with a driver's field of vision or with the range of operation of the armament on a tank. Accordingly, the hinged auxiliary plow portion 138 may be lowered when the plowing assembly 134 is in its raised orientation.

Disposed below main plow portion 136 is a plurality of vertically disposed planar blades 140 which during operation are disposed below the ground surface. The horizontal spacing between adjacent vertical blades is selected to be such that anti-vehicle mines will of necessity be engaged thereby. The blades are provided with an inclined forward surface, so as to raise mines located under the ground surface into engagement with main plow portion 136, so that they may be plowed aside.

A desired depth of operation for blades 140 is determined by means of a gliding surface assemblies 142 which is articulatedly mounted, about respective pivot axes 122' and 124', onto each of arms 122 and 124. The gliding surface assembly 142 includes a sled 144 which is arranged to slide on the ground surface and is formed at its front with a vertical blade 146 for deflecting mines to the side thereof. Sled 144 is rotatably mounted onto a cam slot of a mounting plate 147. Mounting plate 147 is mounted in turn onto a mounting element 148. It is appreciated that sled 144 is permitted to undergo a somewhat complex articulated motion in a single plane within limits defined by the respective cam paths. This mounting arrangement permits selectable adjustment of the penetration depth of the plowing assembly 134 and also permits the sled 144 to be folded when the plowing assembly is in its raised orientation to eliminate interference with operation of the tank.

A chain 150 extends from each auxiliary plow portion 138 to a location on the hull of the vehicle. The length of the chain 150 is selected such that it is slack when the plowing assembly is in its raised orientation but becomes tight when the plowing assembly is lowered, thus pulling on auxiliary plow portion 138 and orienting it towards a generally vertical orientation. The full raised orientation of the auxiliary plow portion 138 is reached only when soil being plowed is forced thereagainst.

Apparatus for automatically lifting the mine plowing assembly is provided separately for each mine plow and comprises a freely rotatable disk 190 which is bearing mounted onto a mounting member 192 which is bolted onto a tension wheel 194 of a tank. Tension wheel 194 engages the tank track and maintains it at a desired tension. Mounted on an outer facing surface of disk 190 are three outer pins 195, 196 and 197 and an inner disposed pin (not shown). Mounted on an inner facing surface of disk 190 is a tooth 100 which is disposed ordinarily out of engagement with corresponding interstices defined between plates of the tank tread.

Mounted on pin 195 is a lifting chain 199 which is attached at its other end to a location 102 fixed onto main plow portion 136. Mounted on pin 196 is a spring 104 which is attached at its other end to main plow portion 136. Spring 104 is operative to urge disk 190 to rotate about its axis in a clockwise direction.

The operation of the plowing apparatus described hereinabove in conjunction with FIG. 5 is described and illustrated in detail in U.S. Pat. No. 4,467,694, the disclosure of which is incorporated herein by reference.

A weighted chain 160 is mounted between the two plowing assemblies to engage and detonate mines intended to be detonated by engagement of the underside of e.g. a tank, with an antenna protruding upward from the mines, such as known in the art. The position of the weighted chain is such that any of this type of mine encountered by the vehicle will be detonated at a safe distance therefrom.

With further reference to FIG. 5, electromagnetic field generator 16 is shown to be mounted onto a portion 204 of vehicle 98, and is operable as described above in conjunction with FIGS. 1–4 to cause detonation of a magnetic mine at a safe distance from the vehicle. According to one embodiment of the invention, a single generator 16 is provided on the vehicle. According to an alternative embodiment of the invention, however, a plurality of generators 16 may be provided on the vehicle so as to provide a more uniform magnetic field therearound. An additional generator is illustrated at 16'.

According to the above-described combination, electromagnetic field generator 16 is activated immediately prior to entry of vehicle 98 into a mine field and is maintained in operation until termination of mine clearing activity. The effective range of generator 16 is such that magnetic mines in the mine field are detonated at a safe distance from the mine plow apparatus. Any non-magnetic mines present in the mine field, such as pressure-activated mines and antenna operated mines will be plowed aside by the mine plowing apparatus.

Figure 6A:
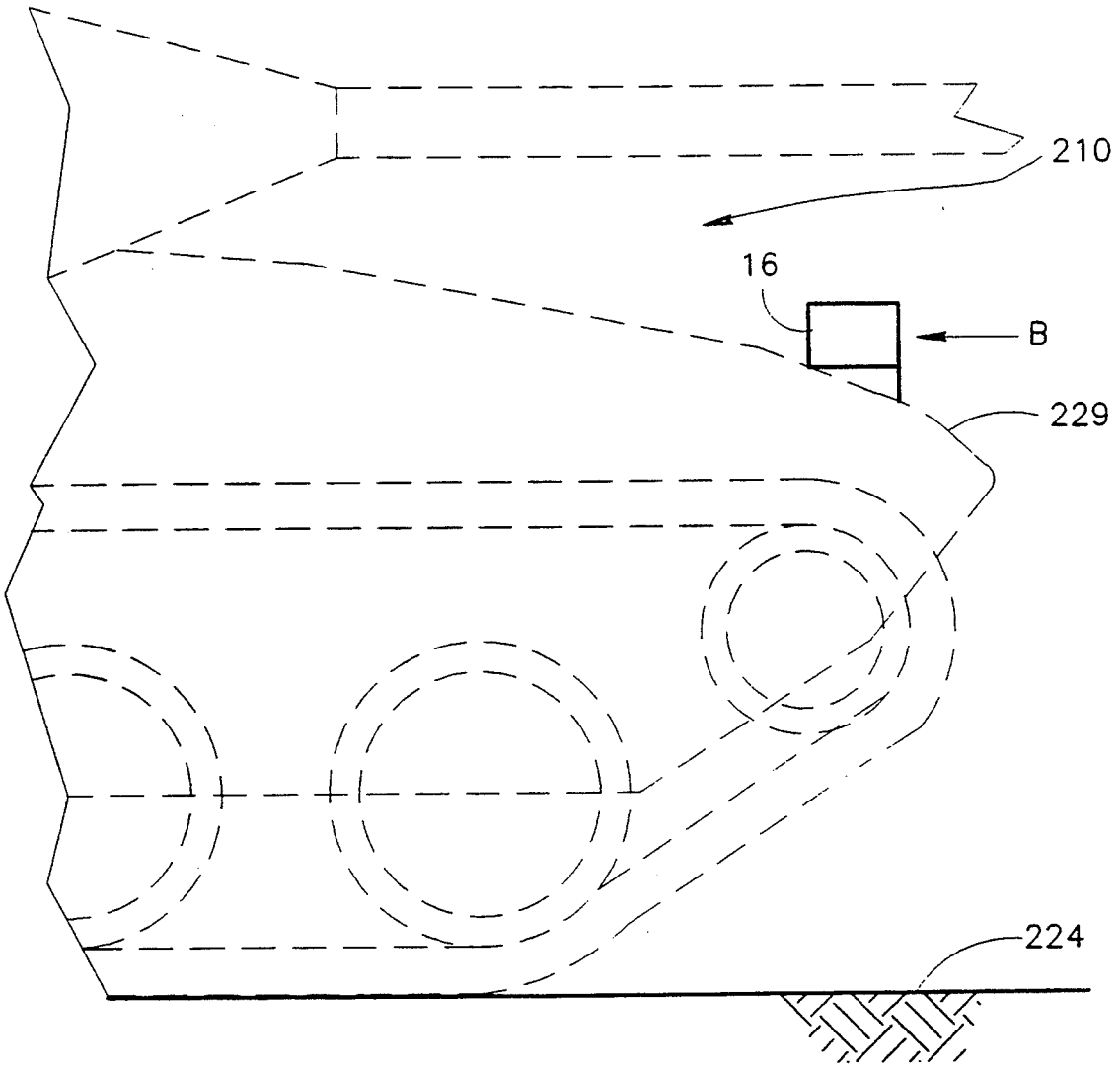
FIGS. 6A and 6B are schematic side and front view illustrations, respectively, of a front portion of a tracked vehicle employing the magnetic mine detonation system of the present invention.
Figure 6B:
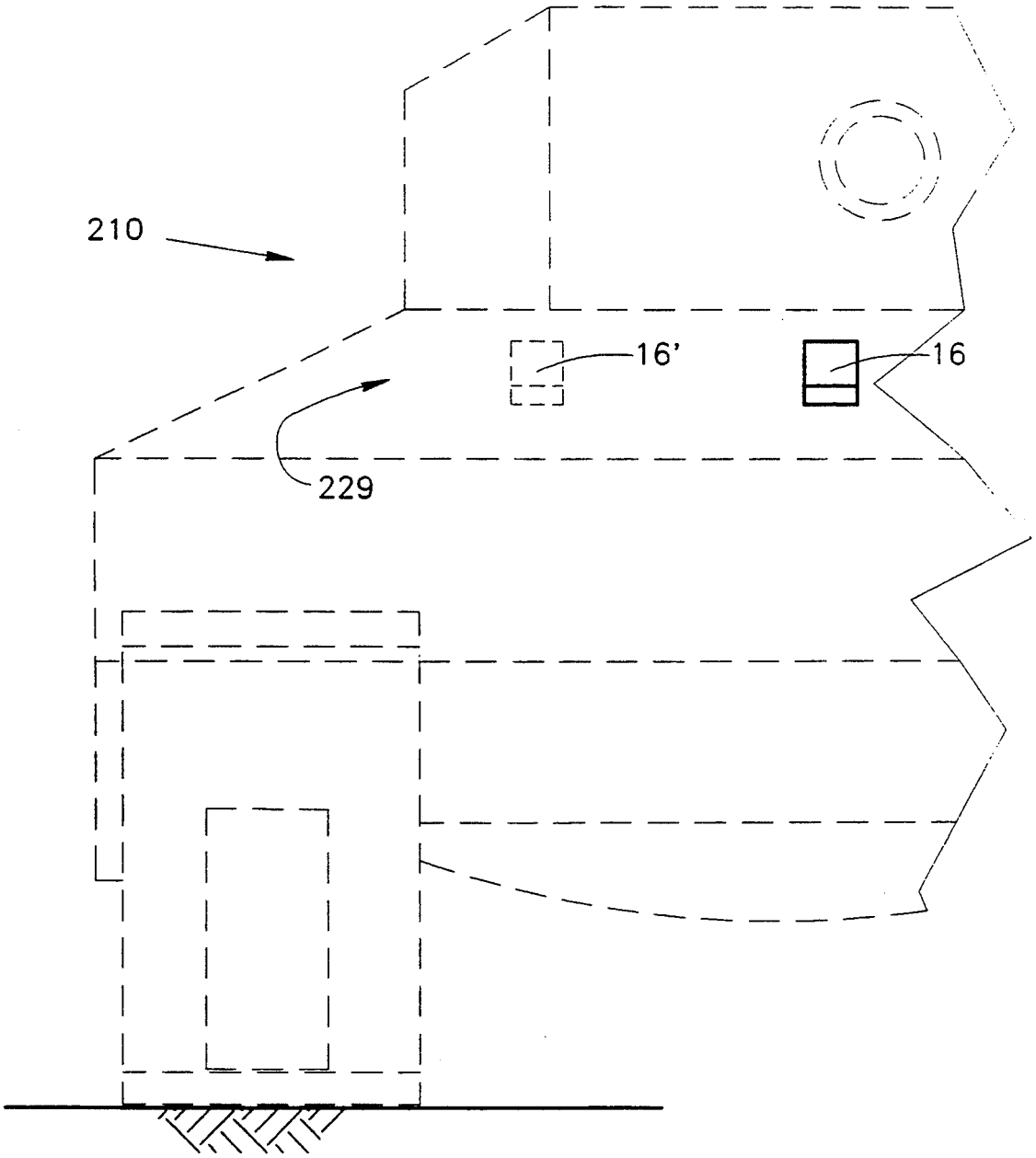

Reference is now made to FIGS. 6A and 6B, which are schematic illustrations of a front portion of a tracked vehicle 210, on which is mounted the magnetic mine detonation apparatus of the invention. Vehicle 210 may be any suitable tracked vehicle, and is typically a main battle tank.

Electromagnetic field generator 16 is shown to be mounted, for example, onto a portion 229 of vehicle 210, and is operable as described above in conjunction with FIGS. 1–4 to cause detonation of a magnetic mine at a safe distance from the vehicle. According to one embodiment of the invention, a single generator 16 is provided on the vehicle. According to an alternative embodiment of the invention, however, one or more additional generators 16' may be provided on the vehicle, as required.

Figure 7A:
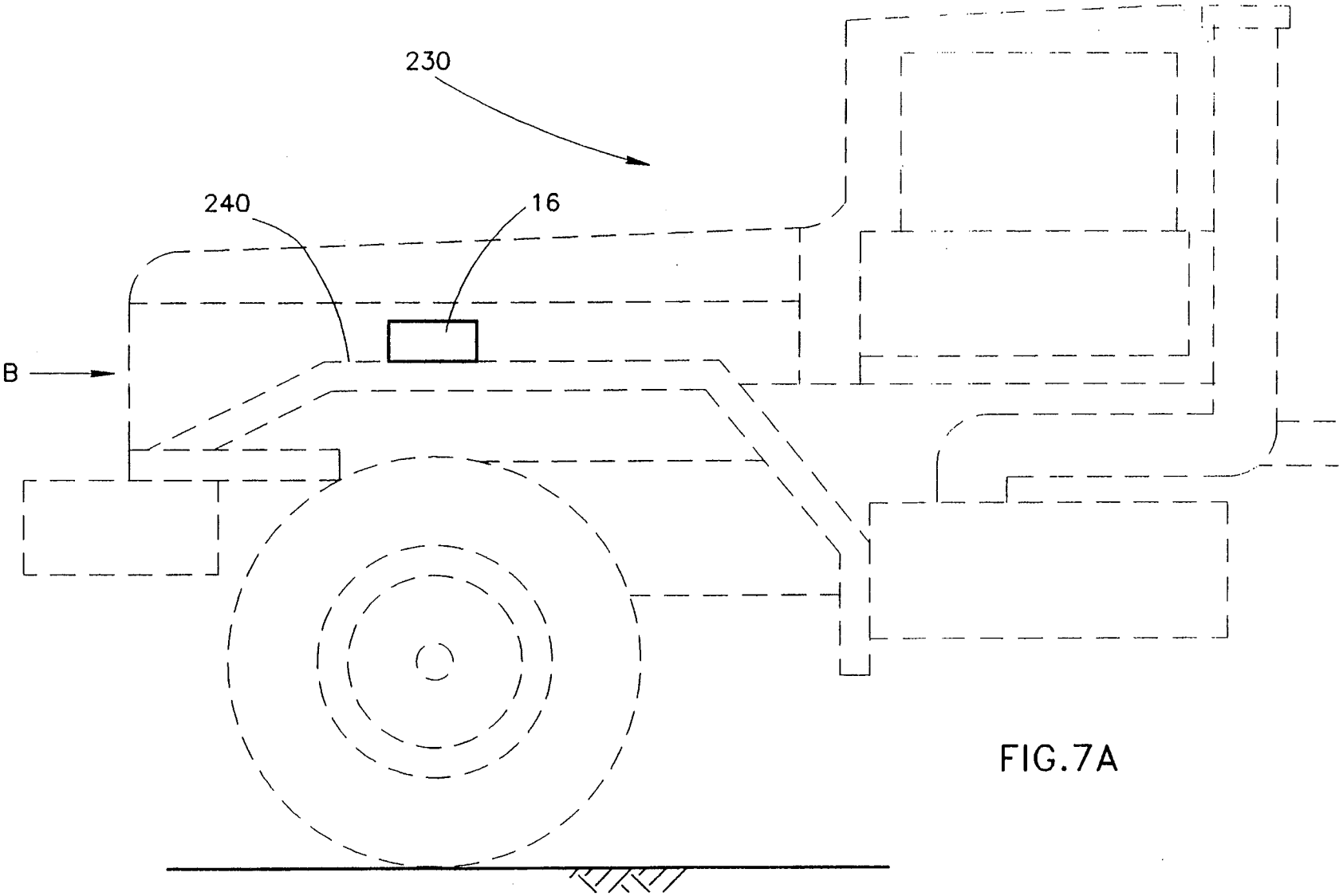
FIGS. 7A and 7B are schematic side and front view illustrations, respectively, of a front portion of a wheeled vehicle employing the magnetic mine detonation system of the present invention.
Figure 7B:
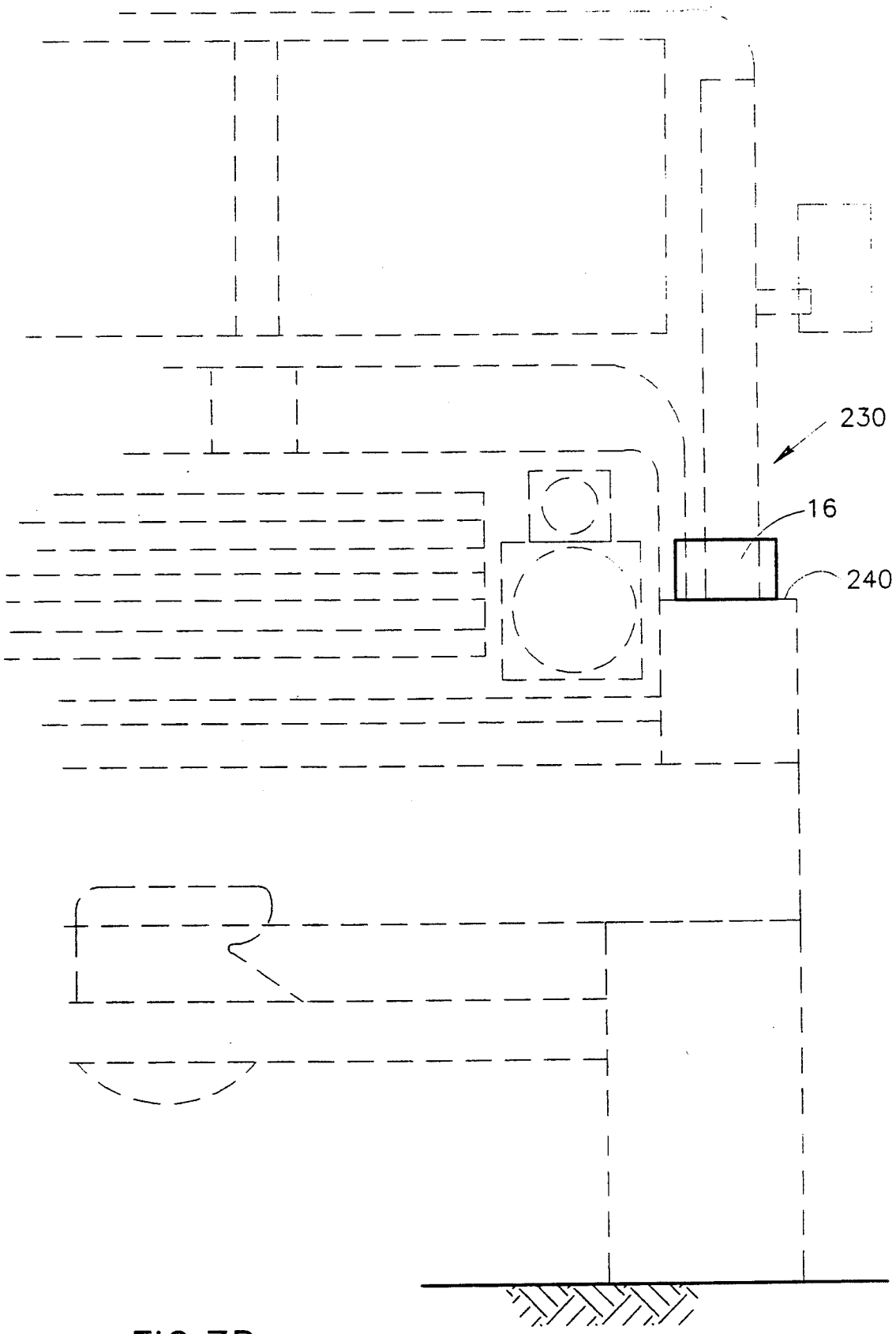

Reference is now made to FIGS. 7A and 7B, which are schematic illustrations of a front portion of a wheeled vehicle 230, on which is mounted the magnetic mine detonation apparatus of the invention. Vehicle 230 may be any suitable vehicle, such as a truck. Alternatively, the wheeled vehicle may also have tracks, such as a half-track.

Electromagnetic field generator 16 is shown to be mounted, for example, onto a portion 240 of vehicle 230, and is operable as described above in conjunction with FIGS. 1–4 to cause detonation of a magnetic mine at a safe distance from the vehicle. According to one embodiment of the invention, a single generator 16 is provided on the vehicle. According to an alternative embodiment of the invention, however, one or more additional generators 16' may be provided on the vehicle, as required.

It will be appreciated by persons skilled in the art that the present invention is not limited by what has been particularly shown and described hereinabove. Rather the scope of the present invention is defined solely by the claims, which follow:

We claim:

1. Apparatus for activating mines having differing activation signatures characterized by different frequencies, said apparatus comprising:

a source of electrical power; and electromagnetic field generating apparatus receiving electrical power from said source and being operative for repeatedly providing a composite mine activation waveform, said waveform including a plurality of waveform portions, each having a different frequency signature, each of said plurality of waveform portions being matched to a different mine.

2. Apparatus according to claim 1, and wherein said electromagnetic field generating apparatus also comprises switching apparatus operative to provide a voltage having a generally square waveform approximating to a sinusoidal waveform.

3. A mobile system for activating magnetic mines, said system comprising:

a vehicle; and electromagnetic field generating apparatus mounted on said vehicle and being operative for repeatedly providing a composite mine activation waveform, said waveform including a plurality of waveform portions, each having a different frequency signature, each of said plurality of waveform portions being matched to a different mine.

4. A system according to claim 3, and wherein said electromagnetic field generating apparatus also comprises switching apparatus operative to provide a voltage having a generally square waveform approximating to a sinusoidal waveform.

5. A mobile system for clearing a safely traversable path through a mine field in which are located nonmagnetic mines and magnetic mines, said system comprising:

a vehicle;

mine clearing apparatus mounted onto said vehicle for clearing a safely traversable path through a field of nonmagnetic mines; and electromagnetic field generating apparatus mounted on said vehicle and being operative for repeatedly providing a composite mine activation waveform, said waveform including a plurality of waveform portions, each having a different frequency signature, each of said plurality of waveform portions being matched to a different mine.

6. A system according to claim 5, and wherein said electromagnetic field generating apparatus also comprises switching apparatus operative to provide a voltage having a generally square waveform approximating to a sinusoidal waveform.

* * * * *